US009702653B2

(12) United States Patent
Cauley, Jr. et al.

(10) Patent No.: US 9,702,653 B2
(45) Date of Patent: Jul. 11, 2017

(54) FIREARM SHOOTING REST

(71) Applicant: Battenfeld Technologies, Inc., Columbia, MO (US)

(72) Inventors: Dennis W. Cauley, Jr., Boonville, MO (US); James Gianladis, Harrisburg, MO (US); Adam J. Birk, Hallsville, MO (US); Matthew Kinamore, Columbia, MO (US); Michael Poehlman, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 14/879,706

(22) Filed: Oct. 9, 2015

(65) Prior Publication Data

US 2017/0102203 A1 Apr. 13, 2017

(51) Int. Cl.
*F41A 23/16* (2006.01)
*F41A 23/02* (2006.01)

(52) U.S. Cl.
CPC ..... *F41A 23/16* (2013.01); *F41A 23/02* (2013.01)

(58) Field of Classification Search
CPC ..... F41A 23/18; F41A 23/00; F41A 23/16; F41A 23/02
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |

(Continued)

FOREIGN PATENT DOCUMENTS

| | | |
|---|---|---|
| DE | 838872 | 5/1952 |
| EP | 0624455 | 11/1994 |
| GB | 475080 | 11/1937 |

OTHER PUBLICATIONS

"American Rifleman: What to do about recoil," LookSmart, http://www.findarticles.com/p/articles/mi_qa3623/is_199907/ai_n886159/print, pp. 1-4, accessed Jan. 4, 2006.

(Continued)

*Primary Examiner* — Benjamin P Lee
(74) *Attorney, Agent, or Firm* — Senniger Powers LLP

(57) ABSTRACT

Shooting rests and associated methods of manufacture and use. A rear support of a shooting rest includes a stop configured to inhibit rearward movement of a firearm when the firearm is supported on the rest and fired. The stop supports a recoil pad for cushioning recoil of the firearm.

23 Claims, 7 Drawing Sheets

(56) References Cited

U.S. PATENT DOCUMENTS 1,195,777 A 8/1916 Burtin
1,250,215 A 12/1917 Panos
1,256,255 A 2/1918 Porter
1,295,688 A 2/1919 Butler
1,367,353 A 2/1921 Craig
1,499,748 A 5/1922 Papouchis
1,457,407 A 6/1923 Stokes
1,488,647 A 4/1924 Quinn
1,491,604 A 4/1924 Fuller
1,639,722 A 8/1927 Whitney
1,693,289 A 11/1928 Warren
1,736,244 A 11/1929 Baker
1,902,040 A 3/1933 Meyer
1,907,181 A 5/1933 Fey
1,927,876 A 9/1933 Meyer
1,928,871 A 10/1933 Swebilius
2,066,218 A 12/1936 Morgan
2,079,510 A 5/1937 King et al.
2,090,930 A 8/1937 Chubb
2,100,514 A 11/1937 Miller
2,121,982 A 6/1938 Pugsley
2,125,353 A 8/1938 Mattson
2,216,766 A 10/1940 Cook
2,232,743 A 2/1941 Swenson
2,297,993 A 10/1942 Tratsch
2,331,372 A 10/1943 Buchanan
2,427,365 A 3/1944 Meister
2,378,545 A 6/1945 Fraser et al.
D147,305 S 8/1947 Sloan
2,432,519 A 12/1947 Garand
2,451,266 A 10/1948 Whittemore
2,455,644 A 12/1948 Barnes
2,476,078 A 7/1949 Banks
2,479,354 A 8/1949 Hanson
2,483,089 A 9/1949 Ferguson
2,484,801 A 10/1949 Anderson
2,508,951 A 5/1950 Kazimier
2,510,380 A 6/1950 Clifford
2,517,268 A 8/1950 Wilson
2,582,140 A 1/1952 Leek
2,638,676 A 5/1953 Callahan
2,677,207 A 5/1954 Stewart
2,701,930 A 2/1955 Dolan
2,729,975 A * 1/1956 Hawthorne ..... F41A 23/16
73/11.04
2,731,829 A 1/1956 Wigington et al.
2,740,530 A 4/1956 Ponder
2,753,642 A 7/1956 Sullivan
2,774,090 A 12/1956 Allinson
2,774,563 A 12/1956 Pribis
2,795,881 A 6/1957 Bellows
2,813,376 A 11/1957 Middlemark
2,817,233 A 12/1957 Dower et al.
2,821,117 A 1/1958 Hultgren
2,847,909 A 8/1958 Kester
2,867,931 A 1/1959 Schreiber
2,874,707 A 2/1959 Koppel
2,877,689 A 3/1959 Pribis
2,894,347 A 7/1959 Woodcock
3,064,976 A 11/1959 Kuhn
2,924,881 A 2/1960 Gee
2,924,904 A 2/1960 Amsler
2,924,914 A 2/1960 Garwood
2,975,540 A 3/1961 Lewis
2,999,788 A 9/1961 Morgan
3,011,283 A 12/1961 Lunn et al.
3,012,350 A 12/1961 Wold
3,013,289 A 12/1961 Sasena
3,023,527 A 3/1962 Leek et al.
3,024,653 A 3/1962 Broadway
3,041,938 A 7/1962 Seabrook
3,055,655 A 9/1962 Chelf
3,060,612 A 10/1962 Brown et al.
3,107,642 A 10/1963 Lakin
3,112,567 A 12/1963 Flanagan
3,125,929 A 3/1964 Peasley
3,128,668 A 4/1964 Dicken
3,137,957 A 6/1964 Ingalls
3,163,420 A 12/1964 Braun
3,175,456 A 3/1965 Goodsell
3,183,617 A 5/1965 Ruger et al.
3,205,518 A 9/1965 Romaine
3,206,885 A 9/1965 Dye
3,225,656 A 12/1965 Flaherty et al.
D203,680 S 2/1966 Allison
3,240,103 A 3/1966 Lamont
3,259,986 A 7/1966 Carr
3,283,425 A 11/1966 Boyd
3,283,643 A 11/1966 Mittelsteadt
3,291,317 A 12/1966 Bowen
3,292,293 A 12/1966 Chiasera et al.
3,320,848 A 5/1967 Ponsness
3,323,246 A 6/1967 Loffler
3,327,422 A 6/1967 Harris
3,330,561 A 7/1967 Kandel
3,343,411 A 9/1967 Lee
3,353,827 A 11/1967 Dun, Jr.
3,370,852 A 2/1968 Kandel
3,406,969 A 10/1968 Tisdell et al.
3,423,092 A 1/1969 Kandel
D215,311 S 9/1969 Born
3,473,673 A 10/1969 Porter
3,486,752 A 12/1969 Colvin
3,499,525 A 3/1970 Kanter
3,510,951 A 5/1970 Dow
3,513,604 A 5/1970 Matsunaga et al.
3,536,160 A 10/1970 Brewer
3,550,941 A 12/1970 Spiro et al.
3,556,666 A 1/1971 Lichenstern
D220,154 S 3/1971 Irelan
3,572,712 A 3/1971 Vick
3,580,127 A 5/1971 Lee
3,583,556 A 6/1971 Wagner
3,584,820 A 6/1971 Butcher, Sr.
3,587,193 A 6/1971 Lewis
3,608,225 A 9/1971 Manuel
3,609,902 A 10/1971 Casull
3,646,704 A 3/1972 Ellsworth
3,648,909 A 3/1972 Wisecarver
3,680,266 A 8/1972 Shiplov
3,680,354 A 8/1972 Phillips, Jr.
3,711,955 A 1/1973 Holt
3,711,984 A 1/1973 Dyer et al.
3,736,243 A 5/1973 Duggan
3,738,101 A 6/1973 Simon-Vermot
3,739,515 A 6/1973 Koon, Jr.
3,743,088 A 7/1973 Henkin
3,744,292 A 7/1973 Michelson
3,745,875 A 7/1973 Kennedy et al.
3,748,950 A 7/1973 Huntington
3,764,219 A 10/1973 Collins
3,769,758 A 11/1973 McDonald
3,771,176 A 11/1973 Herman, Sr.
3,804,238 A 4/1974 Howard
3,813,816 A 6/1974 Funk
3,815,270 A 6/1974 Pachmayr
3,826,559 A 7/1974 Berliner et al.
3,827,172 A 8/1974 Howe
3,842,527 A 10/1974 Low
D233,853 S 12/1974 Ferrara
3,876,078 A 4/1975 Gomes et al.
3,877,178 A 4/1975 Campanelli
3,878,939 A 4/1975 Wilcox
3,885,357 A 5/1975 Hoyt
3,893,266 A 7/1975 Anderson et al.
3,895,803 A 7/1975 Loe
3,899,175 A 8/1975 Loe
3,899,797 A 8/1975 Gunst
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor

(56) References Cited

U.S. PATENT DOCUMENTS 3,961,436 A 6/1976 Hagen et al.
3,964,613 A 6/1976 Anderson, Jr.
3,979,849 A 9/1976 Haskins
3,358,504 A 12/1976 Freebairn
4,007,554 A 2/1977 Helmstadter
4,012,860 A * 3/1977 Auger ..... F41A 23/16 42/94
4,018,339 A 4/1977 Pritz
4,021,971 A 5/1977 McFadden
4,026,057 A 5/1977 Cady
4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,207,699 A 6/1980 Hensley
4,222,305 A 9/1980 Lee
4,223,588 A 9/1980 Simpson
4,233,748 A 11/1980 Ford et al.
D257,687 S 12/1980 Bechtel
4,265,045 A 5/1981 Garbini
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr. et al.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,426,085 A 1/1984 Dixon
4,438,913 A 3/1984 Hylla
4,446,900 A 5/1984 Markovich
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,540,182 A 9/1985 Clement
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Homer
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,715,476 A 12/1987 France
4,715,499 A 12/1987 Franklin
4,716,673 A 1/1988 Williams et al.
4,721,205 A 1/1988 Burt et al.
4,723,472 A 2/1988 Lee
4,729,186 A 3/1988 Rieger
4,732,394 A 3/1988 Stein et al.
4,736,843 A 4/1988 Leonard
4,739,996 A 4/1988 Vedder
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A * 1/1989 Nodo ..... F41A 23/16 42/94
4,807,381 A 2/1989 Southard
4,807,888 A 2/1989 Pidde et al.
4,815,593 A 3/1989 Brown
4,819,359 A 4/1989 Bassett
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,876,814 A * 10/1989 Lombardo ..... F41A 23/04 42/94
4,877,131 A 10/1989 Patros et al.
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A 5/1990 Bell
4,937,965 A 7/1990 Narvaez
D310,302 S 9/1990 Southard
4,956,932 A * 9/1990 Cupp ..... F41C 23/08 42/74
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,056,410 A * 10/1991 Pitts ..... F41A 23/16 89/37.04
5,058,302 A 10/1991 Minneman
5,060,410 A 10/1991 Mueller
5,063,679 A 11/1991 Schwandt
5,067,268 A 11/1991 Ransom
5,070,636 A * 12/1991 Mueller ..... F41A 23/16 42/94
5,074,188 A 12/1991 Harris
5,081,783 A * 1/1992 Jarvis ..... F41A 23/16 42/94

(56) References Cited

U.S. PATENT DOCUMENTS 5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,232,227 A 8/1993 Bateman
5,233,779 A 8/1993 Shaw
5,235,764 A 8/1993 Perazzi
5,237,778 A 8/1993 Baer
5,240,258 A 8/1993 Bateman
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,337,505 A 8/1994 Brown et al.
5,344,012 A 9/1994 Matthews
5,347,740 A 9/1994 Rather et al.
5,351,428 A 10/1994 Graham
5,354,247 A 10/1994 Wilkinson
5,358,254 A 10/1994 Yeh et al.
5,361,505 A 11/1994 Faughn
5,367,232 A 11/1994 Netherton et al.
5,370,240 A 12/1994 Hand
5,375,377 A 12/1994 Kenton
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,433,451 A 7/1995 DeVries
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,525,314 A 6/1996 Hurson
5,540,329 A 7/1996 Vogeley
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
D380,116 S 6/1997 Minneman
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,704,482 A 1/1998 Apps et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,725,096 A 3/1998 Winnard
5,737,865 A 4/1998 Brandl et al.
5,740,625 A 4/1998 Jenkins
5,743,395 A 4/1998 Backer
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,791,499 A 8/1998 Zebbedies
5,811,720 A 9/1998 Quinnell et al.
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,131 A 6/1999 Hossain et al.
5,913,422 A 6/1999 Cote et al.
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,937,561 A 8/1999 Abernethy
5,959,613 A 9/1999 Rosenbreg et al.
5,970,642 A 10/1999 Martin
5,974,719 A 11/1999 Simonek
6,019,375 A 2/2000 West, Jr.
6,021,891 A 2/2000 Anderson
6,032,796 A 3/2000 Hopper et al.
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick, Jr. et al.
6,110,020 A 8/2000 Rolfi
6,121,556 A 9/2000 Cole
6,237,462 B1 5/2001 Hawkes et al.
6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,115 B1 * 10/2001 Cook ..... F41C 23/08
42/74
6,305,117 B1 10/2001 Hales, Sr.
6,309,476 B1 10/2001 Ravenscroft et al.

(56) References Cited

U.S. PATENT DOCUMENTS 6,338,218 B1 1/2002 Hegler
6,390,294 B1 5/2002 Fiore et al.
6,397,720 B1 6/2002 Fox et al.
6,439,515 B1 8/2002 Powers
6,439,530 B1 8/2002 Shoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,557,855 B2 5/2003 Wu
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,860,055 B1 3/2005 Walrath
6,862,833 B1 3/2005 Gutner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,043,862 B2 5/2006 Franks
7,055,279 B2 6/2006 Flores
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
7,165,750 B2 1/2007 McCuskey et al.
7,188,445 B2 3/2007 Lehman
D540,904 S 4/2007 Werner
7,200,966 B2 4/2007 Gooder
7,201,376 B2 4/2007 Kuosa
7,207,567 B1 4/2007 Brown
D543,604 S 5/2007 Minneman
7,213,494 B2 5/2007 James
7,216,404 B1 5/2007 Doyle
7,222,451 B2 5/2007 Keng et al.
7,225,050 B2 5/2007 Sutula, Jr.
7,246,704 B2 7/2007 Brunson et al.
7,258,345 B2 8/2007 Anderson, Jr.
D553,219 S 10/2007 Potterfield
7,281,346 B1 10/2007 Cook et al.
7,313,884 B2 * 1/2008 Eddins ..... F41A 23/16 42/90
D567,895 S 4/2008 Cauley
7,356,960 B1 4/2008 Knitt
7,356,961 B2 4/2008 Williams
7,357,250 B2 4/2008 Hagemann
7,363,740 B2 4/2008 Kincel
7,367,451 B2 5/2008 Pendergraph et al.
7,401,431 B2 7/2008 Pierce et al.
7,410,053 B2 8/2008 Bowen et al.
D576,245 S 9/2008 Potterfield et al.
7,421,815 B1 9/2008 Moody et al.
7,426,800 B2 9/2008 Pierce et al.
7,431,247 B2 10/2008 Bobro
7,481,015 B2 1/2009 Mays
7,536,819 B2 5/2009 Popikow
7,536,820 B2 5/2009 Wade et al.
7,549,247 B1 6/2009 Reese
7,584,690 B2 9/2009 Cauley
D605,246 S 12/2009 Hobbs
7,631,455 B2 12/2009 Keng et al.
7,631,877 B2 12/2009 Zara
7,654,498 B1 2/2010 Beltz
7,658,140 B2 2/2010 Lombardi
7,665,241 B2 2/2010 Oz
7,676,977 B1 3/2010 Cahill et al.
7,681,886 B2 3/2010 Morrow et al.
7,694,973 B1 4/2010 Hofmeister
7,713,180 B2 5/2010 Wickens et al.
7,726,478 B2 6/2010 Potterfield et al.
7,730,824 B1 6/2010 Black
7,743,544 B2 6/2010 Laney et al.
7,774,972 B2 8/2010 Potterfield et al.
7,779,572 B2 8/2010 Potterfield et al.
7,823,317 B2 11/2010 Potterfield et al.
7,845,267 B2 12/2010 Potterfield et al.
7,866,081 B2 1/2011 Seuk
7,883,396 B2 2/2011 Potterfield et al.
7,954,272 B2 6/2011 Potterfield et al.
7,997,021 B2 8/2011 Cauley
8,011,129 B2 9/2011 Cauley et al.
8,096,077 B1 * 1/2012 Caywood ..... F41A 23/005 224/150
8,104,212 B2 1/2012 Potterfield et al.
8,109,028 B2 * 2/2012 Roberts ..... F41A 23/16 42/94
8,245,432 B2 * 8/2012 Letson ..... F41A 23/16 42/94
8,296,988 B2 10/2012 Yale et al.
8,336,708 B2 12/2012 Potterfield et al.
8,371,057 B2 2/2013 Coffield et al.
8,444,056 B2 5/2013 Gamez et al.
8,496,212 B2 7/2013 Keng et al.
8,621,773 B2 * 1/2014 Morrow ..... F41A 23/02 42/94
8,931,193 B1 * 1/2015 Bogart ..... F41A 23/16 248/163.1
9,140,512 B2 * 9/2015 Witchel ..... F41A 25/00
9,151,561 B2 10/2015 Morrow et al.
2002/0195752 A1 12/2002 Yang
2003/0234205 A1 12/2003 McGuyer et al.
2004/0112777 A1 6/2004 Huang
2004/0134113 A1 7/2004 Deros et al.
2005/0115137 A1 6/2005 Minneman
2006/0065560 A1 3/2006 Dickenson et al.
2006/0175213 A1 8/2006 Hurt et al.
2006/0230664 A1 * 10/2006 Eddins ..... F41A 23/16 42/94
2006/0248775 A1 * 11/2006 Wade ..... F41A 23/34 42/94
2006/0254111 A1 11/2006 Giauque et al.
2006/0277811 A1 12/2006 Peterson
2007/0051028 A1 3/2007 Stordal
2007/0068379 A1 3/2007 Sween et al.
2007/0068835 A1 3/2007 Buie, III
2007/0094911 A1 5/2007 Rush et al.
2007/0113460 A1 5/2007 Potterfield et al.
2007/0256346 A1 11/2007 Potterfield et al.
2007/0295197 A1 12/2007 Potterfield
2008/0023379 A1 1/2008 Potterfield et al.
2008/0054570 A1 3/2008 Potterfield et al.
2008/0061509 A1 3/2008 Potterfield
2008/0128002 A1 6/2008 Jeffs
2008/0156671 A1 7/2008 Jansson
2008/0174071 A1 7/2008 Potterfield et al.
2008/0263928 A1 10/2008 Potterfield
2009/0025267 A1 * 1/2009 Reinert ..... F41A 23/16 42/94
2009/0126250 A1 5/2009 Keng
2009/0188146 A1 7/2009 Werner
2010/0102178 A1 4/2010 Smith et al.
2010/0126055 A1 5/2010 Potterfield
2010/0138032 A1 6/2010 Potterfield

(56) References Cited

U.S. PATENT DOCUMENTS

| | | | | |
|---|---|---|---|---|
| 2010/0170128 | A1* | 7/2010 | Werner | F41A 25/10 42/1.06 |
| 2010/0236125 | A1 | 9/2010 | Morrow et al. | |
| 2010/0270201 | A1 | 10/2010 | Cauley et al. | |
| 2011/0024985 | A1 | 2/2011 | Potterfield et al. | |
| 2011/0036214 | A1 | 2/2011 | Potterfield | |
| 2011/0094140 | A1 | 4/2011 | Letson | |
| 2011/0197748 | A1* | 8/2011 | Roberts | F41A 25/04 89/37.04 |
| 2012/0011759 | A1 | 1/2012 | Cauley et al. | |
| 2012/0175844 | A1 | 7/2012 | Potterfield | |
| 2012/0186125 | A1* | 7/2012 | Werner | F41A 23/18 42/94 |
| 2015/0354913 | A1 | 12/2015 | Morrow et al. | |

OTHER PUBLICATIONS

"Cleaning Cradles: Sinclaire Cleaning Cradles" p. 21. 1 pg. The date on which the Sinclair Folding Cleaning Cradle was first on sale is not known, but is believed to be circa 2004.
"Decker Rifle Vise", 1 pg. The date on which the Decker Rifle Vise was first on sale is not known, but is believed to be circa 2004.
"The Grabber and Hustler '76," MEC—Mayville Engineering Company, Inc., 2 pgs., undated.
"Uncle Bud's Bull Bags," http:www.unclebudscss.com/pages/Bulls%20bags.html, 2 pgs. [Internet accessed on Feb. 14, 2006].
"Uncle Bud's Udder Bag," http:www.unclebudscss.com/pages/Udder%20Bags.html, 2 pgs. [Internet accessed on Feb. 14, 2006].
1Shop2.com. "Hoppe's Gunsmith's Fully Adjustable Bench Vise", 3 pgs. The date on which The Hoppe's Gunsmith's Fully Adjustable Bench Vise was first on sale is not known, but is believed to be circa 2004.
AcuSport Outdoor Sporting Products, 3 pgs.
Amazon.com, "CTK® P3 Ultimate Shooting Rest," Sports & Outdoors, http://www.amazon.com/CTK%C2%AE-P3-Ultimate-Shooting-Rest/dp/ . . . , 1 pg. [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 pg. [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/BO . . . , 1 pg. [Internet accessed on Jul. 22, 2008].
Basspro.com, "Bass Pro Shops Outdoors Online: Offering the best in Fishing, Hunting and Outdoor Products," http://www.basspro.com/webapp/wcs/stores/servlet/Product 10151 -1 10001 95064 SearchResults, 2 pgs. [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," file://C:\DOCUME-1\DUTCD\LOCALS-1\Temp\PQ28V28J.htm, 1 pg., accessed Jan. 25, 2006.
Big Boy Gun Toys, "Shooting Rest," http://www.bigboyguntoys.com/shootingrest.htm, 1 pg. [Internet accessed on Jul. 18, 2008].
Boyt Harness Company, Product Catalog, http://www.boytharness.com/catalog/index.php?cPath=22, 2 pgs. [Internet accessed on Jul. 21, 2008].
Brownells, Inc., Catalog No. 41, 1988-1989, 3 pgs.
Brownells, Inc., Catalog No. 57, 2004-2005, 2 pgs.
Brownells, Inc., Catalog No. 47, 1994-1995, 2 pgs.
Brownells, Inc., Sight Base Cutters, Faxed Dec. 17, 2003, 1 pg.
Cabela's Hunting Fishing and Outdoor Gear Master Catalog, Fall2002, Edition II, Minimizer Rifle Rest, Item No. SC-22-4332 and SC-22-4333, p. 492.
Cabela's: World's Foremost Outfitter. "HySkore Sighting System and Cleaning Vise". 1 pg. The date on which the HySkore Sighting System and Cleaning Vise was first on sale is not known, but is believed to be circa Jan. 2005. However, a prototype of this product may have been shown to buyers at Cabela's circa Aug. 2004.
Cabela's. "Master Catalog Fall 2003: Late-Season Edition". Cover page and p. 416. 2 pgs.
Cabela's, "BenchBuddy® Gun Rest," http://www.cabelas.com/cabelas/en/templates/links/link.jsp?id=0005819221954a &type=product&cmCat=, © 1996-2008, 2 pgs. [Internet accessed on Aug. 6, 2008].
Cabela's, "Elite Rifle Rest," http://www.cabelas.com/cabelas/en/templates/links/link.jsp?id=0005817227855a&type=product &cmCat=, © 1996-2008, 2 pgs. [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pgs. [Internet accessed on Aug. 6, 2008].
Cabela's, "Hyskore® Ultimate Sighting Rest," http://www.cabelas.com/cabelas/en/templates/links/link.jsp?id=0024152226083a &type=product&cmCat=, © 1996-2008, 2 pgs. [Internet accessed on Aug. 6, 2008].
Cabela's, "Nitro Shoulder Shield Rest," http://www.cabelas.com/cabelas/en/templates/links/link.jsp?id=0040862228231a &type=product&cmCat=, © 1996-2008, 2 pgs. [Internet accessed on Aug. 6, 2008].
Cabela's, "Premier Rifle Rest," http://www.cabelas.com/cabelas/en/templates/links/link.jsp?id=0020904227856a&type=product &cmCat=. . . , © 1996-2008, 2 pgs. [Internet accessed on Aug. 6, 2008].
Cabela's, "Secure Bench Rest," http://www.cabelas.com/cabelas/en/templates/links/link.jsp;jsessionid=4F0LP0OW2HMRLLAOBBISCOF . . . , © 1996-2008, 2 pgs. [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pgs. [Internet accessed on Aug. 6, 2008].
Cabela's, "Shooting Benches & Portable Rifle Shooting Bench Rest," http://www.cabelas.com/ssubcat-1/cat20793.shtml, 3 pgs. [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pgs. [Internet accessed on Jul. 15, 2008].
Caldwell Shooting Supplies, 2006 Catalog, pp. 18, 5, 12, 14 and 15. 5 pgs.
Califomiavarmintcallers.com—Forum, http://califomiavarmintcallers.com/community/modules/newbb/viewtopic.php?topic_id=10 &forum=9&PHPSESSID=074ed8c7 . . . pp. 1-4 accessed Jan. 16, 2006.
Canadian Camo, "Gun Rest," https://media5.magma.ca/www.canadiancamo.com/catalog/product_info.php?products_id=. . . , 2 pgs. [Internet accessed on Feb. 13, 2006].
Champion Traps & Target, 2005 Product Catalog, 12 pgs.
CTK Precision, "P3 Ultimate Shooting Rest," http://www.ctkprecision.com/index.asp?PageAction=VIEWPROD&ProdOID=2, 3 pgs. [Internet accessed on Jul. 18, 2008].
CTK Precision, All Products, http://www.ctkprecision.com/index.asp?PageAction=VI EWCATS&Cate . . . , 3 pgs. [Internet accessed on Jul. 22, 2008].
CV-500, 3 pgs. [product photos].
E. Arthur Brown Company, "A Shooting Rest that Really Works . . . ," http://www.eabco.comfTargetShooting01.html, © 2007-2008, 1 pg. [Internet accessed Jul. 18, 2008].
Edgewood Shooting Bags Catalog, http://www.edgebag.com/catalog.php, 7 pgs. [Internet accessed on Feb. 14, 2006].
Ellett Brothers, Rests & Gun Vises, 3 pgs.
Four photos of the Lohman Sight Vise. 4 pgs. The date on which the Lohman Sight Vise was first on sale is not known, but is believed to be circa 2004.
Grafix® Plastics, http://www.grafixplastics.com/plastic_film_g.asp?gclid=CK-5-7gnY4CFRVNhQodjFhfSQ, 29 pgs. [Internet accessed on Aug. 30, 2007].

(56) References Cited

OTHER PUBLICATIONS

"Gun Rest-Shooting Rest-Rifle Rests," http://www.exploreproducts.com/gunrests-shootingrests.htm, 6 pgs. [Internet accessed Jul. 18, 2008].
Hyskore, "Rest—Dangerous Game Machine Rest," Hyskore Rest, Professional firearm rests, http://www.hyskore.com/rests.htm, 2 pgs. [Internet accessed Jul. 21, 2008].
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Joe's, "Shooter's Ridge Steady Point Shooting Rest," http://www.joessports.com/product/index.jsp?productId=3155005&cp=726872&parentPag . . . , Item No. 3155005, 1 pg. [Internet accessed Jul. 17, 2008].
Lahti Company Brochure, "Rifle Evaluator: No Pain, No Fear, No Flinching, No Body Movement," www.lahticompany.com, 2 pgs., Undated.
Lahti Company, Evaluator Brochure, http://www.lathicompany.com/Forms/EvaluatorBrochure2.jpg, 2 pgs., accessed Jan. 16, 2006.
MacksPW.com, "Desert Mountain Bench Master Rifle Rest," http://www.macksqw.com/Item-i-DESBM1, © 2004-2008, 1 pg. [Internet accessed Jul. 22, 2008].
Midway USA, "Shooters Ridge Steady Point Rifle Shooting Rest," http://www.midwayusa.com/eproductpage.exe/showproduct?saleitemid=826745&t=11082005, 2005, 5 pgs. [Internet accessed on Aug. 6, 2008].
Midway USA. "Tipton Range Box with Ultimate Rifle, Handgun Cleaning Kit (No Solvents)". <URL: http://www.midwayusa.com/rewriteaproducU135086>. 2 pgs. The date on which the Tipton Range Box was first on sale is not known, but is believed to be circa 2004.
MidwayUSA, "ADG Rifle Shooting Rest," http://www.midwayusa.com/eproductpage.exe/showproduct?saleitemid=992071&t=11082005, 2005, 3 pgs. [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pgs. [Internet accessed on Aug. 6, 2008].
MidwayUSA, "Caldwell Lead Sled DFT Rifle Shooting Rest," http://www. midwayusa.com/eproductpage.exe/showproduct?saleitemid=149023&t=11082005, 2005, 6 pgs. [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pgs. [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pgs. [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pgs. [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pgs. [Internet accessed on 8/6/20081.
MidwayUSA, "Hyskore® dangerous Game Rifle Shooting Rest," http://www.midwayusa.com/eproductpage.exe/showproduct?saleitemid=729197&t=11082005, 2005, 3 pgs. [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 3 pgs. [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005,2005, 3 pgs. [Internet accessed on Aug. 6, 2008].
MidwayUSA, "Shooters Ridge Steady Point Rifle Shooting Rest with Vise," http://www.midwayusa.com/eproductpage.exe/showproduct?saleitemid=341095&t=11082005, D 2005, 4 pgs. [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pgs. [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pgs. [Internet accessed on Aug. 6, 2008].
Milek, B., "Handloading for Hunting New Products from RCBS, Lee, Accurate Arms," Peterson's Hunting, Mar. 1985, p. 21. 1 pg.
Millett, "BenchMaster Shooting Rests," 1 pg. Undated.
MTM Case-Gard. "Gun Maintenance Centers." 2 pgs. The date on which the MTM Gun Maintenance Center was first on sale is not known, but is believed to be circa 2004.
MTM Case-Gard. "Rifle rest and pistol shooting rest". <URL: http://www.mtmcasegard.com/products/shooting/shoo.html>. 3 pgs. The date on which the MTM Site-In-Clean was first on sale is not known, but is believed to be circa 2004.
MTM Shoulder-Gard Rifle Rest, MTM Case-Gard, p. 2 "Rests", 1 pg.
Precision Shooting, Inc., Bald Eagle Front Rest, The Accurate Rifle, vol. 6, Issue No. 4, May 2003, p. 47. 1 pg.
Protektor Model, "The Original Leather Rifle and Pistol Rest," http://www.protektormodel.com/, 12 pgs. [Internet accessed on Feb. 14, 2006].
Shooters Ridge, "Deluxe Rifle Rest," http://www.shootersridge.com, 1 pg. [Internet accessed Jul. 21, 2008].
Shooters Ridge, "Shooting Rest with Gun Vise," http://www.shootersridge.com, 1 pg. [Internet accessed Jul. 17, 2008].
Sinclair International, Sinclair Shooting Rests, Products for the Precision Shooter, 2002, Issue No. 2002-B, pp. 76-78.
Sweeney, P "Gunsmithing: Measure Headspace, Peterson's Rifleshooter," http://www.rifleshootermag.com/gunsmithing/headspace_0612/, 4 pgs. [Internet Accessed Dec. 11, 2004].
Tenex Precision Co. "Recoil A-Rest-R" Product Pictures, 4 sheets, Riverside CA.
The Sportsman's Guide. "Plano Shooters Case!" <URL: http://www.sportsmansguide.com/cb/cb.asp?a=148225>. 3 pgs. The date on which the Plano Shooters Case was first on sale is not known, but is believed to be circa 2004.
Cabela's, "Sharp Shooter Rifle Rest," http://www.cabelas.com/cabelas/en/templates/links/link.jsp?id=0005816222738a&type=product&cmCat=, © 1996-2008, 2 pgs. [Internet accessed on Aug. 6, 2008].
Office Action issued Jun. 7, 2006, U.S. Appl. No. 10/865,595, 6 pgs.
Final Office Action issued Apr. 3, 2007, U.S. Appl. No. 10/865,595, 8 pgs.
BPAI Decision issued Feb. 2, 2011, U.S. Appl. No. 10/865,595, 8 pgs.
Office Action issued Mar. 2, 2009, U.S. Appl. No. 11/431,956, 16 pgs.
Final Office Action issued Nov. 27, 2009, U.S. Appl. No. 11/431,956, 13 pgs.
Restriction Requirement issued Jul. 26, 2010, U.S. Appl. No. 11/431,956, 6 pgs.
Office Action issued Feb. 9, 2011, U.S. Appl. No. 11/431,956, 7 pgs.
Final Office Action issued Oct. 6, 2011, U.S. Appl. No. 11/431,956, 8 pgs.
Office Action issued May 7, 2012, U.S. Appl. No. 11/431,956, 10 pgs.
Final Office Action issued Nov. 23, 2012, U.S. Appl. No. 11/431,956, 10 pgs.
Restriction Requirement issued May 7, 2013, U.S. Appl. No. 11/431,956, 6 pgs.

(56) References Cited

OTHER PUBLICATIONS

Office Action issued Feb. 1, 2012, U.S. Appl. No. 13/009,389, 13 pgs.
Final Office Action issued Aug. 16, 2012, U.S. Appl. No. 13/009,389, 11 pgs.
Restriction Requirement issued Feb. 28, 2013, U.S. Appl. No. 13/009,389, 5 pgs.
Office Action issued Apr. 12, 2013, U.S. Appl. No. 13/009,389, 10 pgs.

* cited by examiner

FIREARM SHOOTING REST

FIELD

The present disclosure generally relates to shooting rests, and more particularly to recoil reducing shooting rests.

BACKGROUND

Firearm shooting sports are often associated with painful recoil that can result from shooting firearms. A large caliber, heavy recoiling firearm can create an unpleasant experience when firing more than a few rounds. Recoil can be described as the equal and opposite reaction to the momentum of an ammunition cartridge's projectile (e.g., bullet) and gunpowder charge upon firing of the cartridge. This momentum is imparted to the firearm, causing it to travel in the opposite direction of the fired bullet.

Shooters commonly use a shooting rest for supporting a firearm in a steady position when practicing with or sighting-in the firearm. Even when using a shooting rest, flinching or jerking the trigger in anticipation of recoil is a common negative factor in a shooter's accuracy and can present challenges when attempting to sight-in the firearm. Shooters commonly fire upwards of twenty rounds when sighting-in, especially in the case of rifles and shotguns using telescopic sights. To reduce discomfort and inaccuracy resulting from recoil, some shooting rests are configured to absorb recoil to reduce the recoil force felt by the shooter.

SUMMARY

One aspect of the present invention is directed to a shooting rest for supporting a firearm. The shooting rest includes a frame. The shooting rest includes a forward support operatively connected to the frame for supporting a forward portion of the firearm. The shooting rest includes a rear support operatively connected to the frame for supporting a rearward portion of the firearm. The rear support includes a stop configured to inhibit rearward movement of the firearm relative to the frame when the firearm is supported on the rest and fired. The stop includes a rear panel having at least one opening therein. The rear support includes a recoil pad for cushioning recoil of a butt of the firearm. The recoil pad includes a resiliently compressible cushion positioned in front of the rear panel and at least one protrusion extending rearward from the cushion through the at least one opening of the rear panel for mounting the recoil pad on the rear panel.

Another aspect of the present invention is directed to a method of manufacturing a shooting rest for supporting a firearm. The method includes assembling a rear support for supporting the rearward portion of the firearm. Assembling the rear support includes mounting a recoil pad of the rear support on a stop of the rear support by disposing at least one protrusion of the recoil pad in at least one opening of the stop.

Another aspect of the present invention is directed to a shooting rest for supporting a firearm. The shooting rest includes a frame. The shooting rest includes a forward support operatively connected to the frame for supporting a forward portion of the firearm. The shooting rest includes a rear support operatively connected to the frame for supporting the rearward portion of the firearm. The rear support includes a stop configured to inhibit rearward movement of the firearm relative to the frame when the firearm is supported on the rest and fired. The stop includes a rigid rear panel. The rear support includes a recoil pad for cushioning recoil of a butt of the firearm. The recoil pad includes a resiliently compressible cushion positioned in front of the rear panel. The cushion has a thickness of at least about 0.5 inch extending between front and rear surfaces of the cushion. The cushion includes thermoplastic material having a durometer between about 20 Shore A and about 60 Shore A.

Other objects and features of the present invention will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
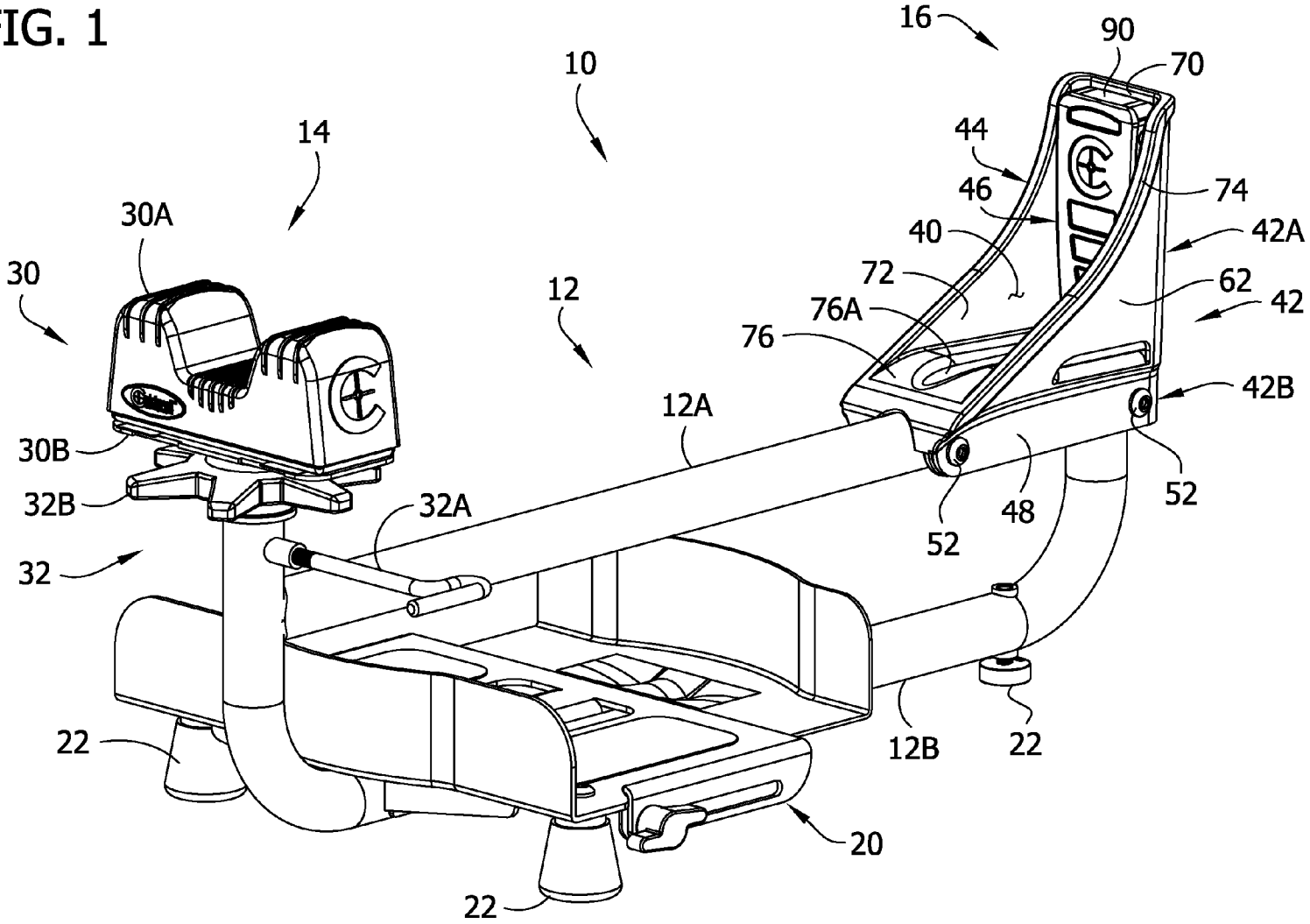
FIG. 1 is a front perspective of a shooting rest embodying aspects of the present invention.
Figure 2:
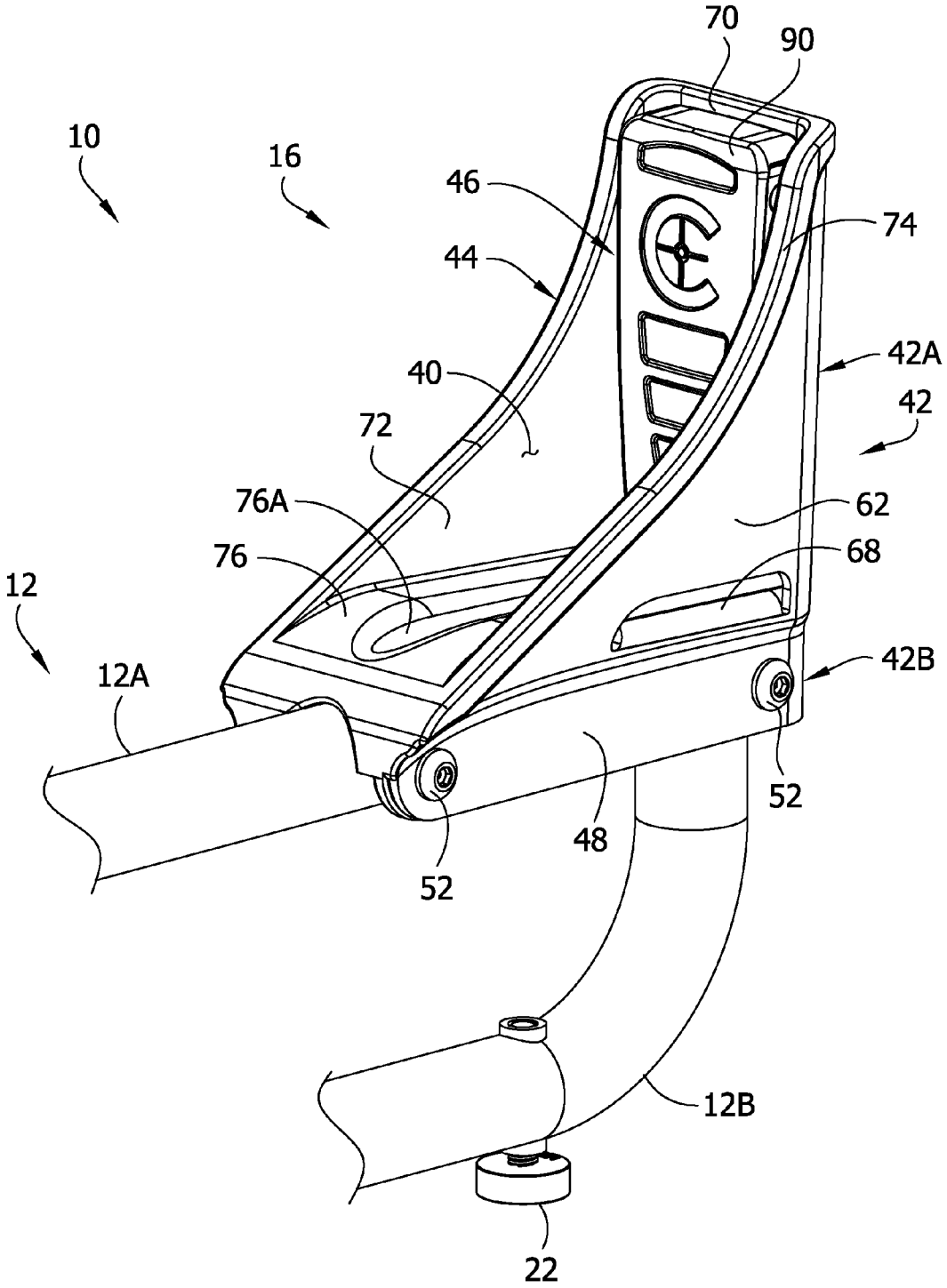
FIG. 2 is an enlarged, fragmentary front perspective of the shooting rest illustrating a rear portion of the shooting rest.

Referring to FIG. 1, a shooting rest is designated generally by the reference number 10. The shooting rest 10 is constructed for supporting a firearm (not shown) in a shooting position so a user can fire the firearm while it is supported by the shooting rest. As will become apparent, the shooting rest 10 assists the user in holding the firearm steady while aimed at a target and is configured for reducing recoil felt by the user when the firearm is fired.

As shown in FIG. 1, the rest 10 includes a frame, generally indicated by the reference number 12, and forward and rear supports, generally indicated by the reference numbers 14 and 16, respectively. The forward and rear supports 14, 16 are connected to the frame 12 and positioned with respect to each other for supporting respective forward and rear portions of a firearm. For example, the forward portion of the firearm could include a barrel and/or forestock of the firearm. The rear portion of the firearm could include a buttstock having a butt.

In the illustrated embodiment, the frame 12 includes an upper frame member 12A and a lower frame member 12B. The lower frame member 12B is a tube having a generally U-shape with upstanding front and rear ends. The upper frame member 12A is a tube spanning the upstanding ends of the U-shaped lower frame member 12B. Other types and configurations of frames can be used without departing from the scope of the present invention.

A weight support 20 for holding one or more removable weights (not shown) is connected to the lower frame member 12B. It will be understood that addition of removable weight onto the weight support 20 can increase the effective mass of the shooting rest 10 for absorbing recoil force when the firearm is fired. Other types and configurations of weight supports can be used, and the weight support can be omitted, without departing from the scope of the present invention. For example, various types of weight supports for supporting removable weight are disclosed in co-assigned U.S. Pat.

Nos. 8,011,129 and 8,621,773, which are hereby incorporated by reference in their entireties.

The rest 10 has three feet 22 for supporting the rest on a support surface such as a table top. Two feet 22 extend downward from opposite sides of the weight support 20, and a third foot 22 extends downward from a rear end of the lower frame member 12B. It will be appreciated that other arrangements for supporting the shooting rest 10 can be used without departing from the scope of the present invention.

Referring to FIG. 1, the forward support 14 includes a cradle 30 for receiving the forward portion of the firearm and a height adjustment assembly 32 configured for adjusting a vertical position of the cradle with respect to the frame. In the illustrated embodiment, the cradle 30 includes a generally U-shaped pad 30A formed of thermoplastic material mounted on a base plate 30B. The height adjustment assembly 32 includes a threaded shaft (not shown) inside the upstanding front end of the lower frame member 12B, and course and fine adjustment members 32A, 32B permitting height adjustment of the cradle 30 for supporting the firearm in a desired orientation with respect to a target. Other types and configurations of front supports can be used without departing from the scope of the present invention. For example, the cradle and the height adjustment assembly can have other constructions or be omitted without departing from the scope of the present invention.

Figure 3:
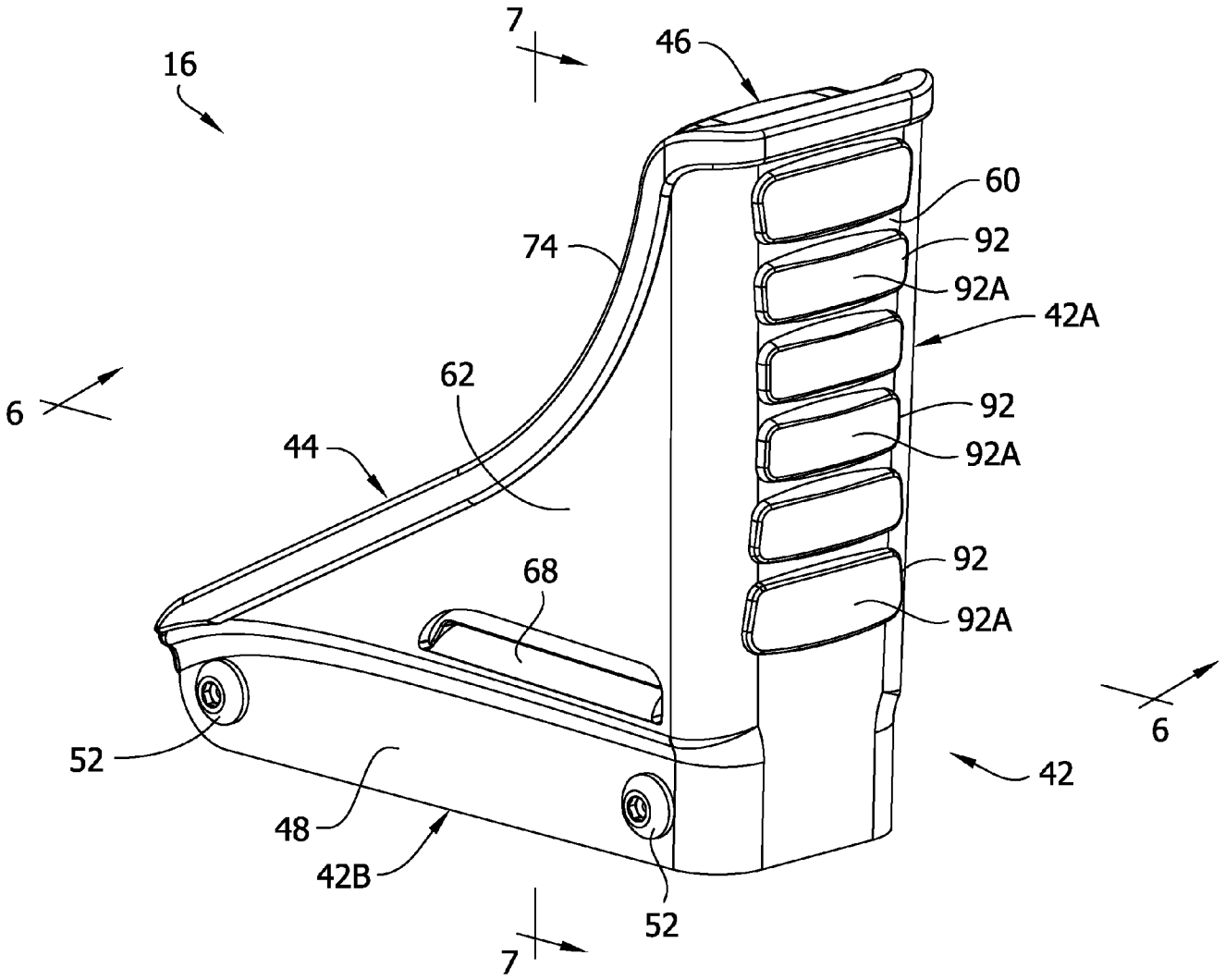
FIG. 3 is a rear perspective of a rear support of the shooting rest.
Figure 4:
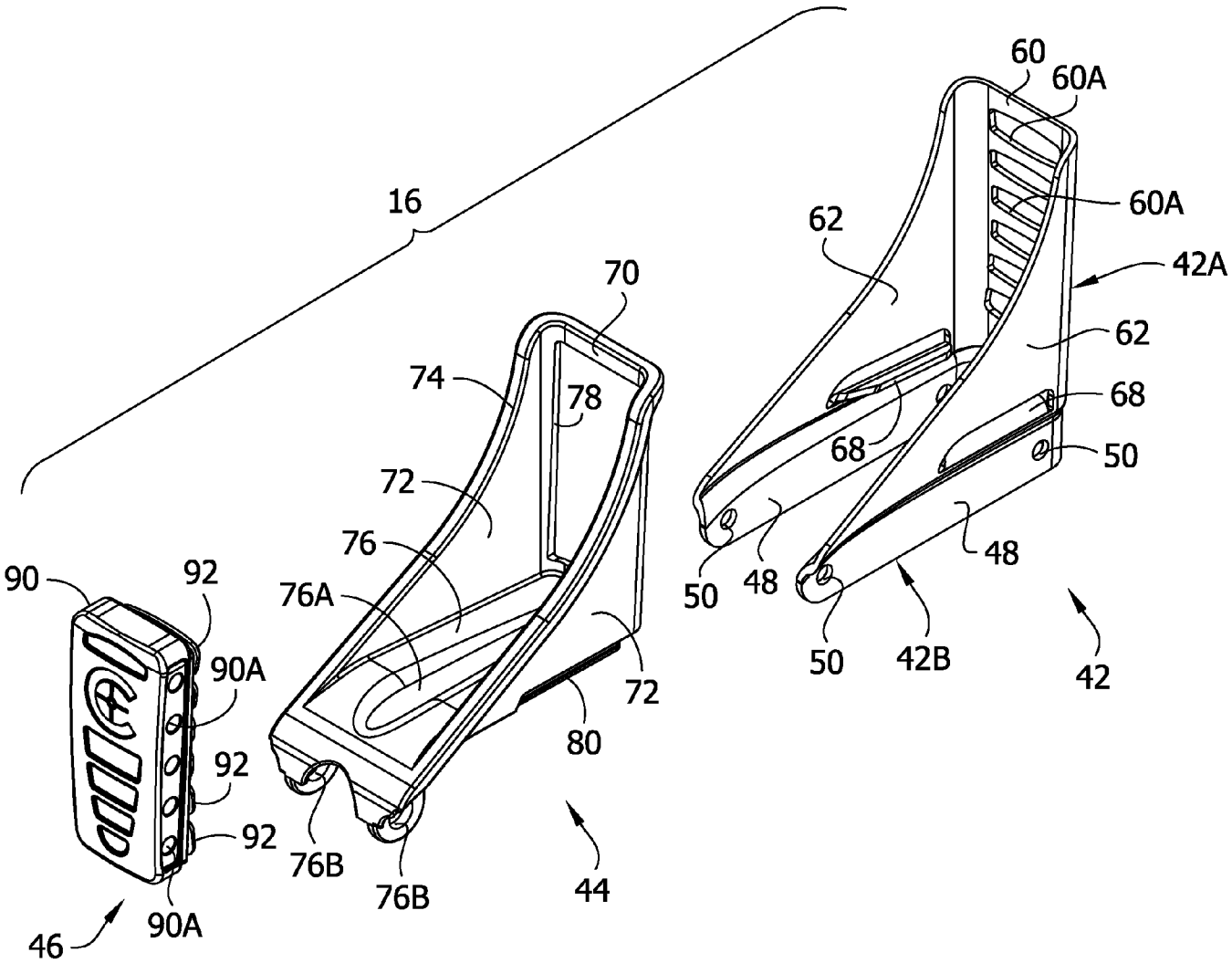
FIG. 4 is an exploded front perspective of the rear support.
Figure 5:
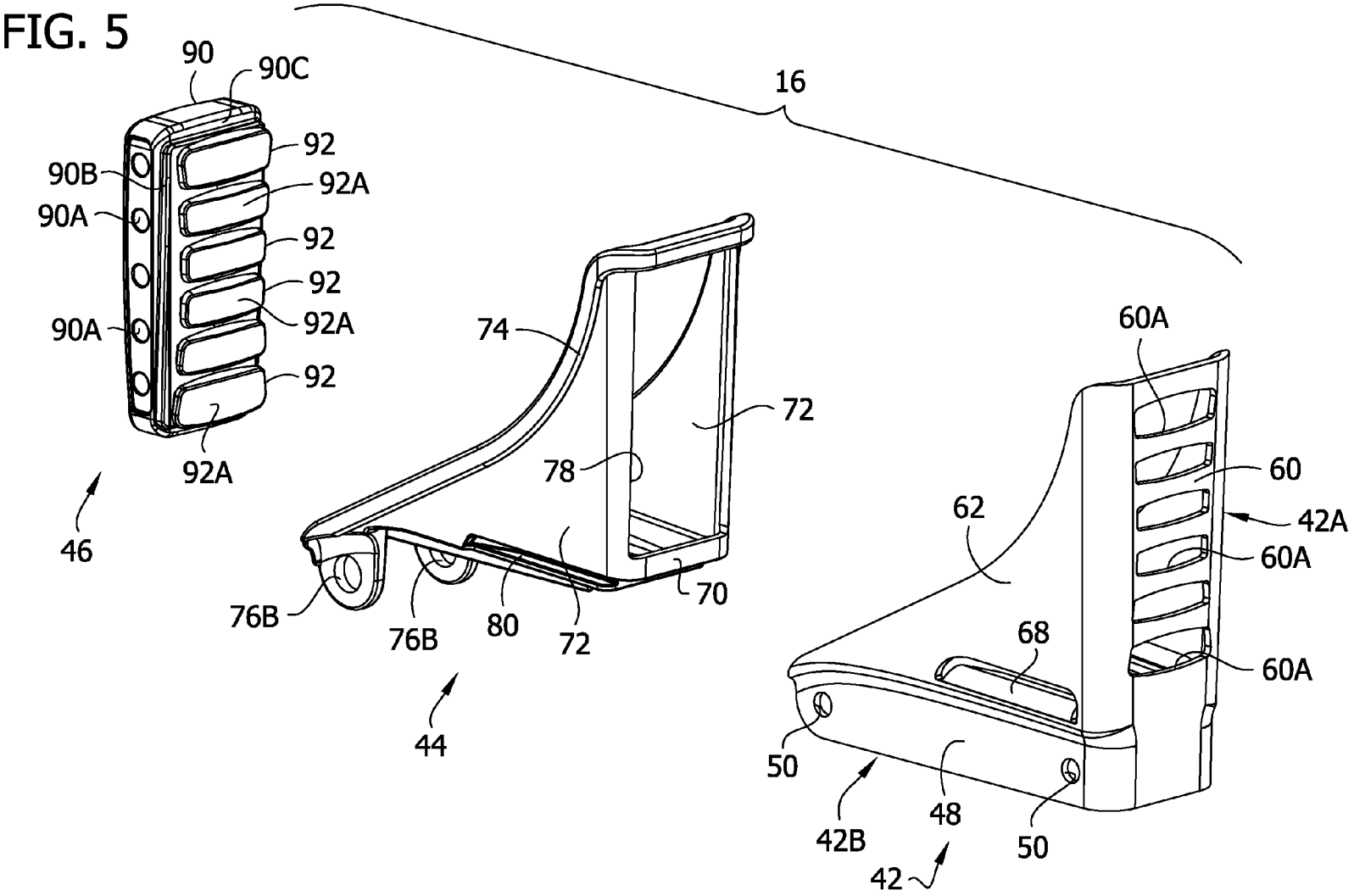
FIG. 5 is an exploded rear perspective of the rear support.

Referring now to FIGS. 2-7, the rear support 16 defines a pocket 40 sized for receiving a portion of the buttstock of the firearm, including the butt of the firearm. As shown in FIGS. 4 and 5, in the illustrated embodiment, the rear support 16 comprises an assembly including a stop 42, a cover 44, and a recoil pad 46. As will become apparent, the stop 42 is configured for inhibiting rearward movement of the firearm relative to the frame 12 when the firearm is fired, the recoil pad 46 is configured for absorbing recoil of the firearm when the firearm is fired, and the cover 44 assists in preventing damage to the buttstock of the firearm by engagement with the stop.

As shown in FIG. 3-5, the stop 42 includes an upper brace portion 42A and a lower mounting portion 42B. For example, the stop 42 can be formed of rigid metal. Other types of rigid material can be used without departing from the scope of the present invention. The lower mounting portion 42B is configured for mounting to the frame 12. In particular, the mounting portion 42B includes side walls 48 spaced sufficiently to receive a rear end of the upper frame member 12A and the top of the upstanding rear portion of the lower frame member 12B. The mounting portion 42B includes two sets of eyelets 50 for receiving bolts 52 for mounting the stop 42 on the frame. The bolted mounting of the stop 42 on the frame provides a rigid connection.

The upper brace portion 42A of the stop 42 includes a rigid rear panel 60 and opposite left and right side rigid panels 62 sized and positioned with respect to one another for use in defining the buttstock receiving pocket 40 with a size and shape for receiving the buttstock therein. The upper brace portion 42A has a size and shape for being engaged by a user's shoulder for aiming and firing the firearm when the firearm is supported on the shooting rest 10.

The rear panel 60 is positioned to back the butt of the firearm in use for inhibiting rearward movement of the firearm relative to the frame 12 when the firearm is fired. The rear panel 60 has an inner surface facing toward the pocket, and an outer surface facing away from the pocket. As shown in FIGS. 4 and 5, the rear panel 60 includes a plurality of openings 60A extending in a row between upper and lower ends of the rear panel. In the illustrated embodiment, the openings 60A are provided in the form of holes passing entirely through the rear panel 60 and having perimeters surrounding the entirety of the respective holes defined by the rear panel. As will be explained in further detail below, the holes 60A are for mounting the recoil pad 46 on the stop 42.

The side panels 62 are positioned on opposite sides of and in front of the rear panel 60 for forming the pocket 40 of the rear support 16. The side panels 62 have respective inner surfaces facing toward the pocket 40 and outer surfaces facing away from the pocket. The side panels 62 have rear ends rigidly connected to respective left and right sides of the rear panel 60. The side panels 62 extend forward from the rear panel 60 and taper in height from their rear ends adjacent the rear panel to their front ends. Opposing flanges 68 extend inward from respective left and right side panels 62 adjacent lower ends of the side panels for engaging and supporting the cover 44, as explained in further detail below.

It will be appreciated that the stop 42 is configured for providing a rigid backing to the recoil pad 46 (i.e., inhibiting rearward movement relative to the frame 12 when the firearm is fired). The stop 42 is configured for transmitting rearward force of the firearm generated during recoil from the stop to the frame 12. Desirably, rearward acceleration caused by the recoil force is substantially resisted by mass of the shooting rest 10 augmented by removable weight supported on the weight support 20, as explained more fully in U.S. Pat. Nos. 8,011,129 and 8,621,773, incorporated by reference above. This reduces recoil felt by the shooter. Other types of rigid connections of the stop to the frame and other types of stops for providing a rigid backing to the recoil pad can be used without departing from the scope of the present invention. For example, the side panels can be omitted. Moreover, the stop can comprise flexible material such as fabric configured for providing a rigid backing to the recoil pad (e.g., fabric defining the rear and side panels).

Referring now to FIGS. 4 and 5, the cover 44 includes a rear wall 70 and left and right walls 72 for lining the respective inner surfaces of the rear panel 60 and left and right panels 62 of the stop 42. The cover 44 includes a lip 74 that extends along upper ends of the rear, left, and right walls 70, 72. The lip 74 overlies top edges of the rear panel 60 and left and right panels 62 for protecting the firearm from rigid edges of the stop 42 around the top and front of the pocket 40. The cover 44 also includes a bottom wall 76 extending between bottom ends of the left and right walls 72 in front of the rear wall 70. In the illustrated embodiment, the bottom wall 76 has a channel 76A for receiving a bottom of the buttstock. The cover 44 includes eyelets 76B extending downward from the bottom wall positioned for receiving the front bolt 52 in the assembled rear support 16 for securing the front end of the cover in position. The rear wall 70 of the cover 44 includes a hole 78 sized for receiving a portion of the recoil pad 46, as explained in further detail below.

Figure 7:
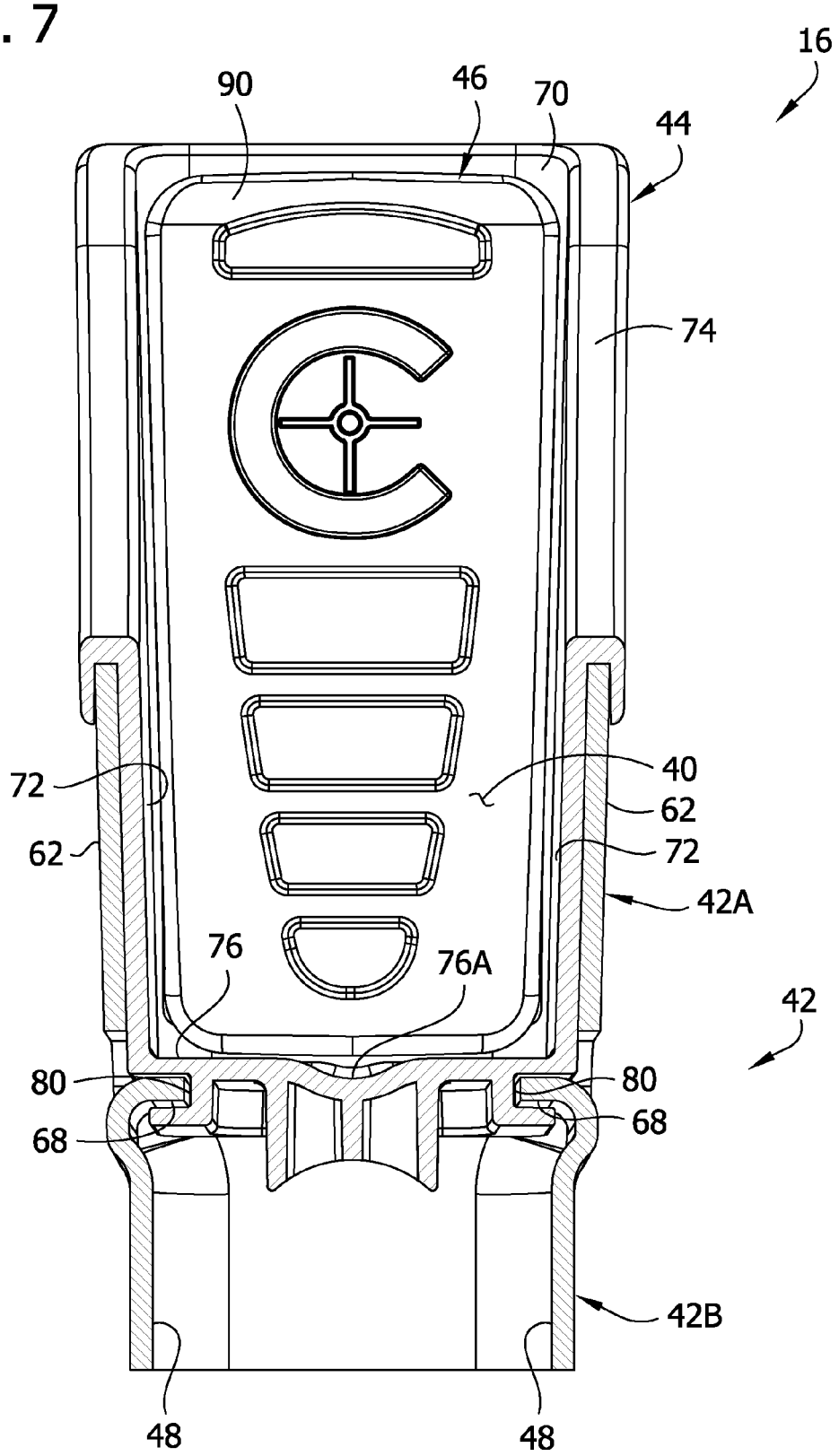
FIG. 7 is a section of the rear support taken in the plane including line 7-7 shown in FIG. 3.

As shown in FIGS. 5 and 7, the cover 44 has slots 80 on opposite left and right sides of the cover positioned for receiving the inward extending flanges 68 of the left and right stop side panels 62. For assembling the rear support 16, the slots 80 are configured for slidingly and matingly receiving the flanges 68 of the stop 42 by aligning rear ends of the slots with front ends of the flanges, and moving the cover 44 rearward toward the rear panel 60 of the stop 42. The reception of the flanges 68 in the slots 80 connects the rear portion of the cover 44 to the stop 42 and maintains the cover seated on the stop, with the lip 74 overlying upper ends of the rear panel 60 and side panels 62.

Desirably, the cover 44 is formed of a thermoplastic material, such as thermoplastic elastomer or thermoplastic rubber, and has a durometer of between about 70 Shore A and about 100 Shore A, such as about 90 Shore A. The term "about" as used herein with reference to durometer means the inclusive range of plus or minus three units of the stated durometer value. It will be appreciated the cover 44 is softer than the stop 42 and is designed to provide protection for the firearm against scratching, marring, or other damage against the stop.

Covers having other configurations can be used, and the cover can be omitted, without departing from the scope of the present invention. For example, the cover can be made of several pieces formed separately from each other, the cover can omit the lip, and/or the cover can be configured for covering more or less of the stop than illustrated.

Figure 6:
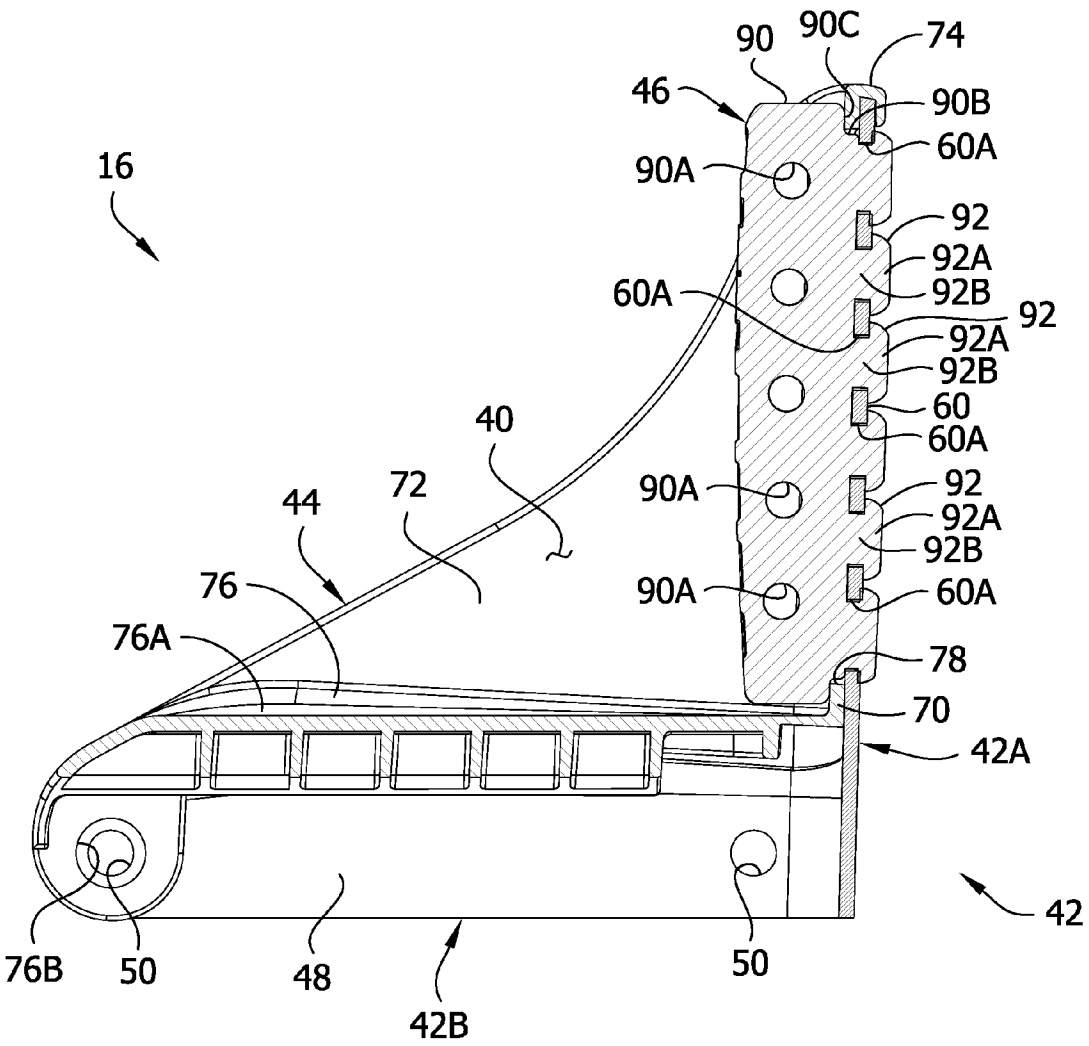
FIG. 6 is a section of the rear support taken in the plane including line 6-6 shown in FIG. 3.

Referring to FIGS. 4, 5, and 6, the recoil pad 46 includes a cushion 90 and a plurality of protrusions 92 extending rearward from the cushion. The cushion 90 is sized for engaging the butt of the firearm when the buttstock is received in the pocket 40. The cushion 90 is configured for cushioning the butt of the firearm during recoil. Desirably, the cushion 90 has a thickness between a front surface and a rear surface of the cushion of at least about 0.5 inch, or between about 0.25 inch and about 2.5 inches, more desirably between about 0.5 inch and about 1.25 inches. In the illustrated embodiment, the thickness of the cushion is about 0.8 inch. The term "about" as used herein with reference to the thickness of the cushion 90 means the inclusive range of plus or minus ⅛ inch of the stated value. The thermoplastic material is desirably resiliently compressible such that the cushion 90 temporarily compresses during recoil of the firearm and expands to assume its original shape when recoil is complete. In the illustrated embodiment, the cushion 90 has multiple voids 90A therein in the form of generally cylindrical bores extending between and opening out of the opposite left and right sides of the cushion. The voids 90A are spaced from each other between the upper and lower ends of the cushion. It will be appreciated that the voids 90A increase the resilient compressibility of the cushion 90 for absorbing an increased amount of firearm recoil. The voids can be sized to provide the cushion with a void percentage of at least 10%, at least 20%, or at least 30%. For example, the void percentage could be between 10% and 45%, or between 20% and 40%. In the illustrated embodiment, the void ratio is about 27%. Desirably, the recoil pad 46 is formed of a thermoplastic material, such as thermoplastic elastomer or thermoplastic rubber, and the cushion 90 (and optionally the remainder of the recoil pad) has a durometer of between about 20 Shore A and about 60 Shore A, and more desirably between about 30 Shore A and about 50 Shore A. In one example, the cushion has a durometer of about 40 Shore A. It will be appreciated that the cushion 90 is softer than the cover 44 to provide cushioning action against recoil force and prevent damage to the firearm buttstock resulting from recoil. However, the cushion 90 can be firmer than the cover 44 or have the same softness as the cover without departing from the scope of the present invention.

As shown in FIGS. 5 and 6, the rear face of the cushion 90 includes a rearward projecting portion 90B of reduced height and width having a cross-sectional shape and size closely corresponding to the shape and size of the hole 78 in the rear wall 70 of the cover 44. The rear face of the cushion 90 includes a rearward peripheral edge margin surface 90C surrounding and offset forward from the projecting portion 90B. In the assembled configuration of the rear support 16, the rearward projecting portion 90B of the rear face of the cushion 90 is received in the hole 78 of the cover 44 and engages the inner surface of the rear panel 60 of the stop 42, and the peripheral edge margin surface 90C of the cover rear face overlies and engages the peripheral edge margin surrounding the hole 78 in the cover 44.

Referring to FIGS. 3, 5, and 6, the protrusions 92 extending rearward from the cushion 90 are configured for mounting the recoil pad 46 on the rear panel 60 of the stop 42. The protrusions 92 include respective heads 92A and necks 92B constructed for reception in the holes 60A in the rear panel 60 of the stop 42. In the assembled configuration of the rear support 16, the necks 92B are received in the holes 60A, and the heads 92A are on the outer side of the rear panel 60. The heads 92A have a relatively larger height and width compared to the holes 60A such that rearward facing surfaces of the heads overlie and engage peripheral edge margins of the outer surface of the rear panel 60 around the holes. The arrangement is such that engagement of the heads 92A with the outer side of the rear panel 60 retains the protrusions 92 in the holes 60A for maintaining the recoil pad 46 on the rear panel. It will be appreciated that, in this position, the recoil pad 46, and in particular the offset peripheral edge margin surface 90C of the rear cushion face and the heads 92A of the protrusions sandwich the rear wall 70 of the cover 44 against the rear panel 60 of the stop 42. Accordingly, the rear support assembly 16 is rather robust and reinforced. Desirably, the heads 92A of the protrusions 92 are resiliently deformable to permit insertion of the heads through the holes 60A in the stop rear panel 60 and to return to their original shape after passed therethrough for retaining the protrusions in the holes.

Recoil pads having other configurations can be used without departing from the scope of the present invention. For example, the recoil pad can be formed as one piece with the cover, the recoil pad can be made of multiple parts formed separately from each other (e.g., separately formed cushion and protrusions), and/or the recoil pad can have more, fewer, or other types of protrusions for mounting the recoil pad on the stop.

As is now apparent, the stop 42, cover 44, and recoil pad 46 can be formed separately and assembled to manufacture the rear support 16. The cover 44 can be positioned in front of the stop 42 and moved rearward to engage the slots 80 with the flanges 68 of the stop. Rearward movement of the cover 44 also brings left and rights sides of the lip 74 into overlying engagement with the top edges of the left and right panels 62 of the stop 42. The portion of the lip 74 adjacent the upper end of the rear wall 70 of the cover 44 can be temporarily deformed to be moved into overlying engagement with the top edge of the rear panel 60 of the stop 42. The recoil pad 46 can be positioned in front of the cover 44 and stop 42 and moved rearward such that the protrusions 92 become seated in the holes 60A in the rear panel 60 of the stop, and the rear face of the cushion 90 becomes seated in the hole 78 in the rear wall 70 of the cover.

In use, the firearm can be supported on the forward and rear supports 14, 16 of the shooting rest 10 for shooting the firearm. The user can engage his shoulder on the rear support 16 and adjust the orientation of the rest 10 and firearm for aiming the firearm at a target. Upon firing the firearm, a portion of the rearward recoil force is absorbed by the resilient compression of the recoil pad 46, a significant amount of the rearward recoil force is transmitted by the stop 42 to the frame 12 for absorbing the force with removable weight on the weight support 20, and the user feels a significantly reduced recoil force on their shoulder against the stop. A recoil pad constructed according to the present invention has been tested and was shown to reduce recoil by about 30% more than a similarly constructed rear support with a cover provided merely to prevent marring of the firearm on the rear support. Accordingly, the rear support 16 disclosed herein provides not only an improved construction for manufacturing assembly purposes, but also an improved performance in reducing recoil. The recoil pad 46 and cover 44 not only protect the buttstock of the firearm from damage against the hard surface of the rear panel 60, but the recoil pad actually serves a substantial role in reducing recoil by absorbing recoil force.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A shooting rest for supporting a firearm having a forward portion and a rearward portion rearward from the forward portion, the shooting rest comprising:

a frame;

a forward support operatively connected to the frame for supporting the forward portion of the firearm;

a rear support operatively connected to the frame for supporting the rearward portion of the firearm, the rear support including a stop configured to inhibit rearward movement of the firearm relative to the frame when the firearm is supported on the rest and fired, the stop including a rear panel having at least one opening therein, the rear support further comprising a recoil pad for cushioning recoil of a butt of the firearm, the recoil pad including a resiliently compressible cushion positioned in front of the rear panel and at least one protrusion extending rearward from the cushion through the at least one opening of the rear panel for mounting the recoil pad on the rear panel.

2. A shooting rest as set forth in claim 1 wherein the at least one opening in the rear panel comprises a hole and the rear panel defines a perimeter surrounding the hole.

3. A shooting rest as set forth in claim 1 wherein the at least one protrusion includes a head and a neck, the neck connecting the head to the cushion and extending through the at least one opening, the head having a forward facing surface overlying a rearward facing surface of the rear panel for retaining the protrusion in the at least one opening.

4. A shooting rest as set forth in claim 1 wherein the cushion and protrusion are formed as one piece with each other.

5. A shooting rest as set forth in claim 1 wherein the at least one opening of the rear panel comprises a plurality of openings and the at least one protrusion of the recoil pad comprises a plurality of protrusions corresponding to respective openings.

6. A shooting rest as set forth in claim 5 wherein the protrusions include heads arranged in a row extending between upper and lower ends of the rear panel.

7. A shooting rest as set forth in claim 1 further comprising a cover for covering at least a portion of the stop.

8. A shooting rest as set forth in claim 7 wherein the stop includes left and right panels in front of the rear panel, and the cover includes left and right sides configured for covering inside surfaces of the left and right panels of the stop.

9. A shooting rest as set forth in claim 7 wherein the cover is formed separately from the recoil pad.

10. A shooting rest as set forth in claim 9 wherein the cover includes an opening in front of the rear panel, the recoil pad being received in said opening in the cover.

11. A shooting rest as set forth in claim 10 wherein the cover includes an edge margin adjacent said opening in the cover and the recoil pad includes a rearward facing surface overlying the edge margin.

12. A shooting rest as set forth in claim 7 wherein the stop includes opposite inwardly extending flanges received in slots in the cover.

13. A shooting rest as set forth in claim 7 wherein the cover comprises a thermoplastic material.

14. A shooting rest as set forth in claim 13 wherein the cushion comprises a thermoplastic material, the thermoplastic material of the cover having a durometer of between about 70 Shore A and about 100 Shore A, and the thermoplastic material of the cushion having a durometer of between about 20 Shore A and about 60 Shore A.

15. A shooting rest as set forth in claim 1 wherein the cushion comprises a thermoplastic material having a durometer between about 20 Shore A and about 60 Shore A.

16. A shooting rest as set forth in claim 15 wherein the cushion has a thickness of at least 0.5 inch extending between front and rear surfaces of the cushion for cushioning recoil of the firearm.

17. A shooting rest as set forth in claim 16 wherein the cushion includes a plurality of voids therein.

18. A shooting rest as set forth in claim 17 wherein the plurality of voids comprise bores extending between opposite left and right sides of the cushion.

19. A method of manufacturing a shooting rest for supporting a firearm having a forward portion and a rearward portion rearward from the forward portion, the method comprising:

assembling a rear support for supporting the rearward portion of the firearm;

wherein assembling the rear support comprises mounting a recoil pad of the rear support on a stop of the rear support by disposing at least one protrusion of the recoil pad in at least one opening of the stop;

wherein disposing the protrusion in the opening comprises disposing a neck of the protrusion in the opening, the neck being narrower than a body of the recoil pad from which the protrusion protrudes.

20. A method as set forth in claim 19 wherein the rear portion of the firearm includes a butt, and mounting the recoil pad on the stop comprises arranging a cushion of the recoil pad for cushioning the butt of the firearm when the butt of the firearm is received on the rear support.

21. A method as set forth in claim 19 wherein disposing the at least one protrusion in the at least one opening comprises deforming the protrusion to force the protrusion into the opening.

22. A method as set forth in claim 21 wherein deforming the protrusion comprises resiliently deforming a head of the protrusion and after disposing the protrusion in the opening permitting the head to resiliently assume a non-deformed configuration.

23. A method of manufacturing a shooting rest for supporting a firearm having a forward portion and a rearward portion rearward from the forward portion, the method comprising:

assembling a rear support for supporting the rearward portion of the firearm;

wherein assembling the rear support comprises mounting a recoil pad of the rear support on a stop of the rear support by disposing at least one protrusion of the recoil pad in at least one opening of the stop;

wherein mounting the recoil pad on the stop comprises sandwiching a stop cover between the recoil pad and the stop.

* * * * *